US006599155B2

(12) United States Patent
Watanabe

(10) Patent No.: US 6,599,155 B2
(45) Date of Patent: Jul. 29, 2003

(54) CONNECTOR STRUCTURE

(75) Inventor: Kunihiko Watanabe, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/057,911

(22) Filed: Jan. 29, 2002

(65) Prior Publication Data

US 2002/0102887 A1 Aug. 1, 2002

(30) Foreign Application Priority Data

Jan. 30, 2001 (JP) ..... 2001-020868

(51) Int. Cl.[7] ..... H01K 11/22
(52) U.S. Cl. ..... 439/852; 439/181; 439/856
(58) Field of Search ..... 439/852, 181, 439/851, 850, 849, 845, 862, 856

(56) References Cited

U.S. PATENT DOCUMENTS 5,997,327 A * 12/1999 Vergne et al. ..... 439/181
6,129,569 A * 10/2000 Fernandez ..... 439/181
6,382,998 B2 * 5/2002 Miwa ..... 439/181
6,478,593 B2 * 11/2002 Miwa ..... 439/856

FOREIGN PATENT DOCUMENTS

JP 8-306278 11/1996
JP 2000-277198 10/2000

OTHER PUBLICATIONS

English Language Abstract of JP–8–306278.
English Language Abstract of JP–2000–277198.

* cited by examiner

*Primary Examiner*—Renee Luebke
*Assistant Examiner*—Felix O. Figueroa
(74) *Attorney, Agent, or Firm*—Greenblum & Bernstein, P.L.C.

(57) ABSTRACT

A connector structure includes a connector body having a hollow portion and an axis. The connector body includes a male terminal extending along the direction of the axis of the hollow portion. The connector body includes a sacrificial electrode mounted either on part of the connector body or on the male terminal. The tip of the sacrificial electrode extends outwardly farther than the male terminal tip along the axis. The connector structure includes a female terminal to be fitted along the axis. The female terminal includes a first sacrificial fold and a second sacrificial fold separated by an electrode path extending along the axis of the hollow portion, such that the sacrificial electrode is positioned between the first and second sacrificial folds before the female terminal has been fitted with the male terminal. With such a construction, the connector structure can be miniaturized and simplified, and durably protected from the damage caused by an electric arc discharge.

20 Claims, 4 Drawing Sheets

CONNECTOR STRUCTURE

BACKGROUND OF THE INVENTION

1. Field of the Invention

The present invention relates to a connector structure used in electricity-generating installations. Such a structure is typically equipped with male and female terminals, and these terminals tend to be damaged by electric arcs, generated between them when they are connected or disconnected. The invention thus relates to, in particular, a connector structure provided with apparatus for preventing such damage in the male and female terminals.

2. Description of Related Art

In an electricity-generating installation using a solar source, a number of panels, each having a small heat-generating capacity, are connected to one another so as to build up a certain level of electricity-generating capacity. Normally, connections of these panels are made on installation sites.

In order to stabilize their electrical capacity and shorten assembly time, these panels are connected through connectors. However, such electricity generating panels using a solar source begin to function as soon as they receive sunlight. An electrical discharge phenomenon is thus produced between the terminals each time the connectors are joined or disconnected on an installation site. This phenomenon involves electric arc discharge, which tends to damage the terminals to an extent where the terminals become unusable.

In order to solve such problems, a terminal structure, such as shown in FIGS. 1A, 1B and 1C, has been proposed and disclosed in Japanese Patent Application published under No. HEI 8-306278.

In the above figures, a female connector 8 with a hollow portion includes a first electrode 1 and a first sacrificial electrode 2. The first electrode 1 includes a receiving hole 1*a*, and a first contact section 1*b* arranged at the closed end of the receiving hole 1*a*. By contrast, a male connector 3 includes a second electrode 4 insertable into the receiving hole 1*a* and having a second contact section 4*a*. A second sacrificial electrode 5 is then mounted around the second electrode 4 in a freely slidable way. A flange portion 6 is fixed around the second electrode 4, and a spring 7 is installed in a compressed condition between the flange portion 6 and the second sacrificial electrode 5.

When the female connector 8 and the male connector 3 are to be connected in the above connector structure, the second electrode 4 is inserted into the receiving hole 1*a*, as shown in FIG. 1B. The first and the second sacrificial electrodes 2 and 5 are first placed into contact, followed by the contact between the first and the second contact sections 1*b* and 4*a*, leading to electrical connections between the first and second electrodes 1 and 4.

FIG. 1C shows schematically a condition in which the male connector 3 is disengaged from the female connector 8. To disengage the male connector 3 and the female connector 8 from a position in which the second sacrificial electrode 5 is pressed upon the first sacrificial electrode 2 by the force of the spring 7, the second contact section 4*a* of the second electrode 4 is first separated from the first contact section 1*b* of the first electrode 1. Then, this action is followed by the separation of the second sacrificial electrode 5 from the first sacrificial electrode 2. In this manner, an electric arc discharge is generated between the first sacrificial electrode 2 and the second sacrificial electrode 5, but not between the first contact section 1*a* and the second contact section 4*a*. As a result, these contact sections 1*a* and 4*a* can be protected from damage.

However, the above known connector structure requires the installation of the second sacrificial electrode 5 slidable along the second electrode 4, as well as of the spring 7 and other peripheral parts. Such a construction thus tends to increase the size and complexity of the connector structure. Furthermore, as the spring 7 wears out with time, the second sacrificial electrode 5 tends to disengage from the first sacrificial electrode 2, before the second contact section 4*a* is separated from the first contact point 1*b*. An electric arc is thus discharged between the first contact section 1*b* of the first electrode 1 and the second contact section 4*a* of the second electrode 4, and causes damage.

An object of the invention is therefore to provide a connector structure having a small and simple construction, which can durably protect the terminal contact sections from damage which can occur as a result of electric arc discharge.

SUMMARY OF THE INVENTION

According to an aspect of the invention, there is provided a connector structure including a connector body having a hollow portion with an axis, the connector body including a male terminal with a tip extending along the axis of the hollow portion, and configured to receive a female terminal along the hollow axis.

The connector body includes a sacrificial electrode, the tip of which extends outwardly farther than the tip of the male terminal along the axis of the hollow portion, and the female terminal includes a first sacrificial fold and a second sacrificial fold respectively having side edges and forming a slit extending along the axis of the hollow portion, such that, when the female terminal is fitted with the male terminal, the sacrificial electrode is positioned in the slit between the first and second sacrificial folds and between the side edges thereof.

Typically, the sacrificial electrode may be formed on the male terminal. Alternatively, the sacrificial electrode may be formed on a part of the connector body and placed into contact with the male terminal.

The connector structure of the invention may further include a tongue spring capable of pressing the male terminal toward the first and second sacrificial folds.

Preferably, the female terminal, the first and second sacrificial folds and the tongue spring are formed unitarily and in one piece.

The invention also relates to an electricity generating panel connected by a connector structure including a connector body having a hollow portion with an axis, the connector body including a male terminal with a tip extending along the axis of the hollow portion, and configured to receive a female terminal along the axis of the hollow portion.

In the above panel, the connector body includes a sacrificial electrode, the tip of which extends outwardly farther than the tip of the male terminal along the axis of the hollow portion, and the female terminal includes a first sacrificial fold and a second sacrificial fold respectively having side edges and forming a slit extending along the axis of the hollow portion, such that, when the female terminal is fitted with the male terminal, the sacrificial electrode is positioned in the slit between the first and second sacrificial folds and between the side edges thereof.

The invention may further include an electricity generating panel that employs a solar source.

When the female terminal is to be fitted with the male terminal, the tip of the sacrificial electrode first approaches the sacrificial folds. Accordingly, an electric arc discharge is generated between the tip of the sacrificial electrode and the side faces of the sacrificial folds. This in turn avoids the arc discharge from being generated between the contact sections of the male and female terminals.

When the male and the female terminals are disengaged, their contact sections are disconnected first, and the sacrificial electrode tip and the sacrificial fold's side faces are disengaged thereafter. Therefore, the electric arc discharge is generated between the sacrificial electrode tip and the sacrificial fold's side faces, but not between the contact sections of the male and female terminals.

As a result, those contact sections are protected from the actions of electric arc discharge. Typically, the sacrificial electrode is formed either on the connector body or on the male terminal. Moreover, the separate sacrificial folds are formed by simply slitting apart the female terminal. The connector structure can thus be miniaturized and simplified. Furthermore, as the electric arc discharge is confined to the area between the above sacrificial electrode and folds, the contact sections are durably protected from the electric arc.

Further still, the sacrificial electrode is designed to extend outwardly farther than the tip of the male terminal. Thus, when the male terminal is being fitted with the female terminal, the sacrificial electrode is first positioned between the sacrificial folds. The sacrificial folds can then be moved along the sacrificial electrode very easily, and the fitting of the male and female terminals becomes very smooth.

According to a further aspect of the present invention, the connector structure may include a connector body having a hollow portion and an axis, the connector body including a male terminal with a tip extending along the axis of the hollow portion, and configured to receive a female terminal along the axis of the hollow portion, the connector body including a sacrificial electrode, the tip of which extends outwardly farther than the tip of the male terminal along the axis of the hollow portion, and the female terminal including a first sacrificial portion and a second sacrificial portion of the hollow portion and forming a slit extending along the axis of the hollow portion, such that, when the female terminal is fitted with the male terminal, the sacrificial electrode is positioned in the slit between the first and second sacrificial portions.

BRIEF DESCRIPTION OF THE DRAWINGS

The above, and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1A:
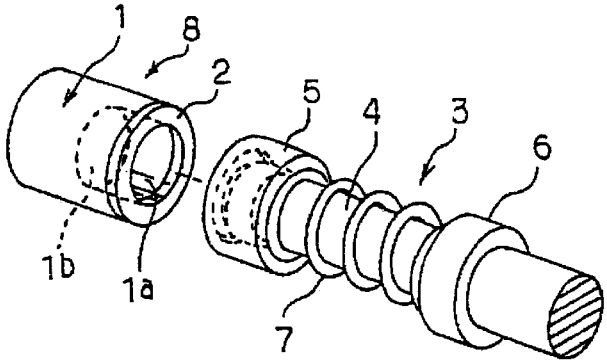
FIG.1A PRIOR ART
FIG. 1A is a perspective view of a connector structure of the prior art.
Figure 1B:
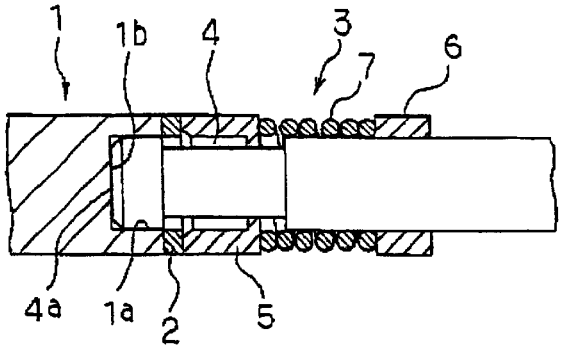
FIG.1B PRIOR ART
FIG. 1B is a partial cross-sectional side view of a male connector and a female connector of the connector structure of FIG. 1A, when they are connected.
Figure 1C:
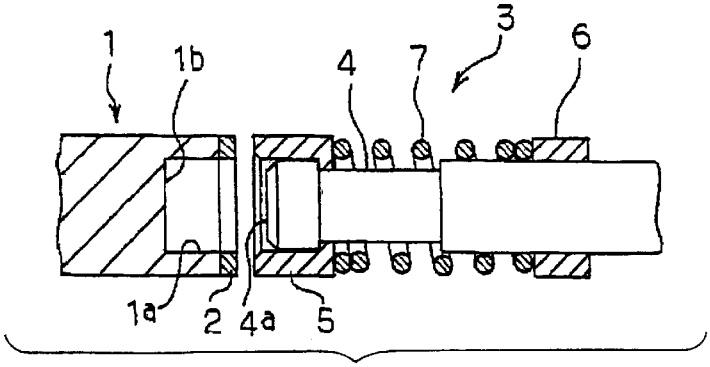
FIG.1C PRIOR ART
FIG. 1C is a partial cross-sectional side view of the same male and female connectors of FIG. 1A when they are disconnected.
Figure 2A:
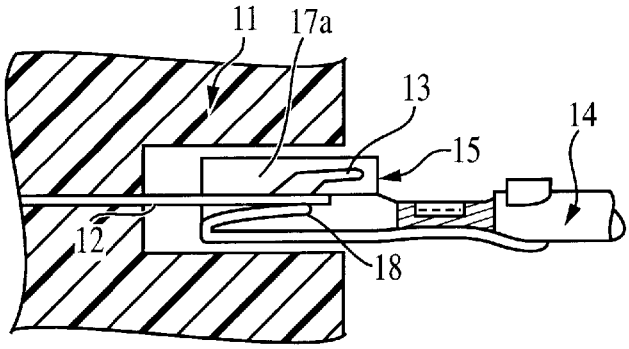
FIG. 2A is a cross-sectional side view of a connector structure, according to an aspect of the present invention, when the male and female terminals are connected.
Figure 2B:
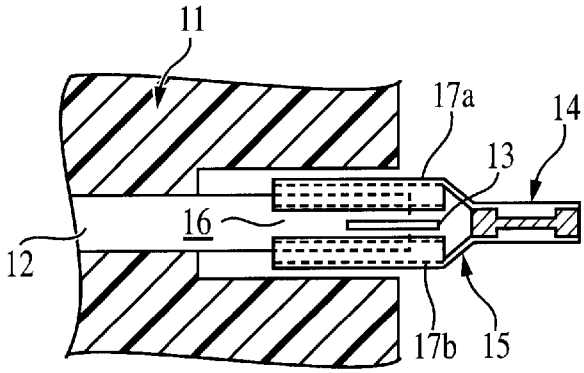
FIG. 2B is a cross-sectional plan view of the connector structure of FIG. 2A.

A connector body 11 shown in FIGS. 2A and 2B includes a male terminal 12, and may be fitted with solar electricity generating (battery) panels known to those skilled in the art. The construction of a solar battery and connectors used for the battery is well known in the art.

The base of a sacrificial electrode 13 may be attached to the male terminal 12 by any suitable attaching device, such as, for example, welding; or may be formed unitarily and in one piece with the male terminal 12 in an integral fashion. The tip of the sacrificial electrode 13 extends outwardly farther than the tip of the male terminal 12.

The tip of an electrical cable 14 is provided with a hollow female terminal 15 to be fitted with the male terminal 12. The female terminal 15 may take any form, and in the present embodiment, takes the form of a channel having a substantially rectangular cross-section, the open side-edges of which are bent inwardly, so that they can be placed in contact with the top face of the incoming male terminal 12. Accordingly, the top face of the male terminal 12 and the open side-edges of the female terminal 15 respectively form a corresponding contact section. Likewise, the inwardly bent sections of the female terminal 15 respectively form first and second sacrificial folds 17*a* and 17*b*, and define an electrode path 16 therebetween, along the direction of the cable. In this manner, before the male terminal 12 is fitted into the female terminal 15, the sacrificial electrode 13 formed on the male terminal 12 is positioned in the electrode path 16 interposed between the sacrificial folds 17*a* and 17*b*.

Figure 2C:
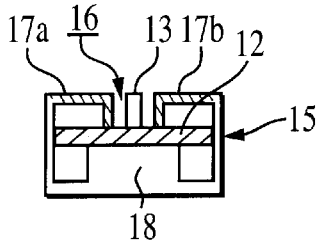
FIG. 2C is a cross-sectional end view of the connector structure of FIG. 2A.
Figure 3A:
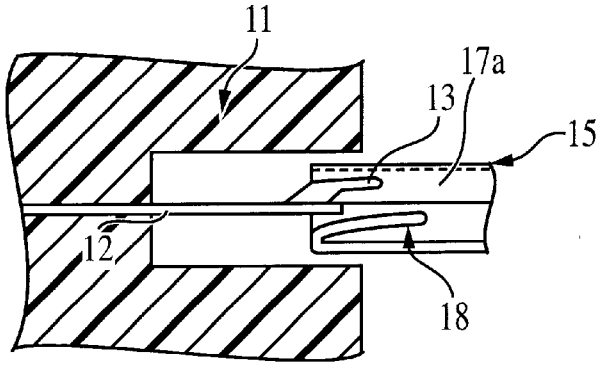
FIG. 3A is a cross-sectional side sectional view of the connector structure of FIG. 2A, when the female terminal is being released from the male terminal.
Figure 3B:
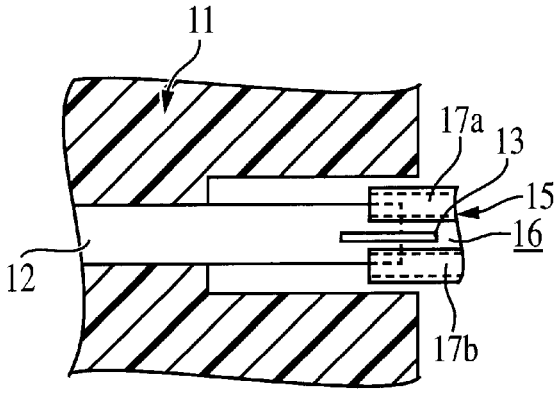
FIG. 3B is a cross-sectional plan view of the connector structure of FIG. 2A, when the female terminal is being released from the male terminal.

In the above structure, the sacrificial folds 17*a* and 17*b* may form a part of the female terminal 15. The sacrificial folds 17*a* and 17*b* may have any desirable cross-sectional length (see FIG. 2C). The sacrificial folds 17*a* and 17*b* and the female terminal 15 may be formed of any suitable material and may be formed of the same or different material. The sacrificial folds 17*a* and 17 may be formed unitarily and in one piece with the female terminal 15 or may be formed separately.

The bottom side of the female terminal 15 is provided with a tongue spring 18. The tongue spring 18 may be formed unitarily and in one piece with the female terminal 15. However, they may also be formed and prepared separately and joined thereafter. The tongue spring 18 presses the male terminal 12 against the bottom ends (in FIGS. 2A and 2C) of the sacrificial folds 17*a* and 17*b*, so as to connect the male terminal 12 firmly to the female terminals 15.

Figure 4:
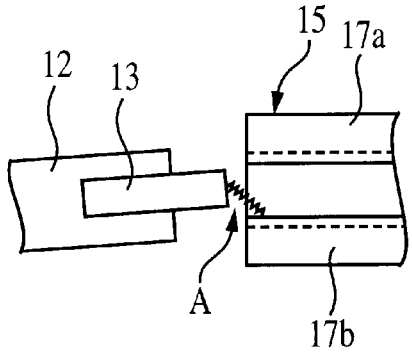
FIG. 4 shows when an electric arc has been discharged between a sacrificial electrode and one of the sacrificial folds.

As the female terminal 15 is fitted with the male terminal 12, the tip of the sacrificial electrode 13 first approaches the sacrificial folds 17*a* and 17*b*. An electric arc is thus discharged between the inwardly bent sections of the sacrificial folds 17*a* and 17*b* and the sacrificial electrode 13. This phenomenon is schematically shown in FIG. 4 with arrow A. When the female terminal 15 is pushed into the male terminal 12, the sacrificial folds 17*a* and 17*b* move smoothly along the sacrificial electrode 13, up to the point where the male and the female terminals 12 and 15 are finally connected. When connected, the tongue spring 18 presses the male terminal 12 towards the sacrificial folds 17*a* and 17*b*, so that the male and the female terminals 12 and 15 are firmly fitted to each other.

When the female terminal 15 is disengaged from the male terminal 12 by simply pulling the male terminal 12 out of the female terminal 15, the female terminal 15 is moved away against the thrusting force of the tongue spring 18. According to this process, the tip of the sacrificial terminal 13 is moved away from the inwardly bent sections of the sacrificial folds 17*a* and 17*b*, only after the contact section of the male terminal 12 (top face thereof) has been separated from the contact portion of the female terminal 15 (open side-edges of the sacrificial folds 17*a* and 17*b*). An electric arc is thus caused to occur between the tip of the sacrificial electrode 13 and the side faces of the sacrificial folds 17*a* and 17*b*, as shown in FIG. 4.

In the above construction, the tip of the sacrificial electrode 13 and the inwardly bent sections of the sacrificial folds 17*a* and 17*b* are brought closer at the outset of fitting of the male and female terminals 12 and 15, and at the final stage of their disengagement. Consequently, the contact sections of the male and female terminals 12 and 15 are freed from the electric arc discharge, as the electric arc discharge is caused between the tip of the sacrificial electrode 13 and the inwardly bent sections of sacrificial folds 17*a* and 17*b*.

By virtue of the structure including: i) a sacrificial electrode 13 provided in the connector body, ii) an electrode path formed in the female terminal 15 and iii) sacrificial folds 17*a* and 17*b* separated by the electrode path, the electric arc is discharged forcibly between the sacrificial electrode 13 and the sacrificial folds 17*a* and 17*b*. The structure of the male and female terminals 12 and 15 is simple, and can thus be miniaturized. Nonetheless, their contact sections are freed from an electric arc discharge effect during use.

Figure 5:
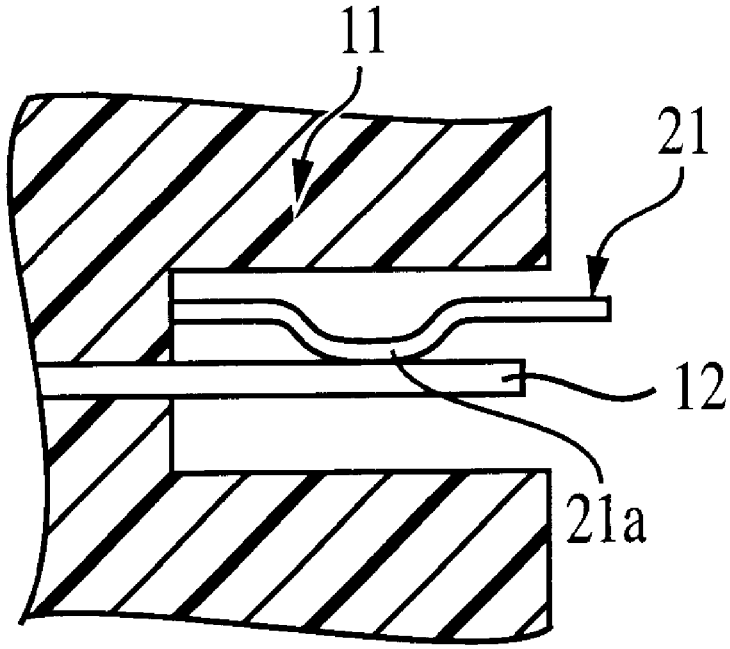
FIG. 5 is a side sectional view of a variant sacrificial electrode.

In the above embodiment, the sacrificial electrode 13 is formed unitarily and in one piece with the male terminal 12. However, as a variant embodiment, a sacrificial electrode 21 may be mounted directly on the connector body 11 (see FIG. 5). In such a case, a mid-portion of the variant sacrificial electrode 21 is bent to form a U-shape portion 21*a*, so that this portion is placed into contact with the male terminal 12. The tip portion thereof extends further outwardly from the tip of the male terminal 12.

According to the present invention, the contact sections of the male and female terminals may be protected from damage in an easy fashion. Further, by virtue of the above-mentioned structural features, the electric arc discharge takes place between the sacrificial electrode and the sacrificial folds. The structure is thus simple and compact, but the protection of the contact sections is nonetheless durable.

Further, as the sacrificial electrode extends outwardly farther than the male terminal tip, the sacrificial electrode is first placed between the sacrificial folds, prior to fitting the male and female terminals. In this manner, the sacrificial folds can be moved smoothly along the sacrificial electrode, and the male terminal and the female terminal fitted to each other very snugly.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not limited to the particulars disclosed. Rather, the invention extends to all functionally equivalent structures, methods, and uses such as are within the scope of the appended claims.

The present disclosure relates to subject matter contained in priority Japanese Application No.2001-020868, filed on Jan. 30, 2001, which is herein expressly incorporated by reference in its entirety.

What is claimed:

1. A connector structure comprising a connector body having a hollow portion and an axis, the connector body including a male terminal with a tip extending along the axis of the hollow portion, and a female terminal configured to be received by the male terminal along the axis of the hollow portion;

said connector body comprising a sacrificial electrode, a tip of said sacrifical electrode extends outwardly farther than said tip of said male terminal along the axis of the hollow portion; and said female terminal comprising a first sacrificial fold and a second sacrificial fold defining a hollow portion having side edges and forming a slit extending along said axis of the hollow portion, such that, when said female terminal is fitted with said male terminal, said sacrificial electrode is positioned in said slit between said first and second sacrificial folds and between said side edges thereof.

2. The connector structure according to claim 1, wherein said sacrificial electrode is formed on said male terminal.

3. The connector structure according to claim 2, the female terminal further comprising a tongue spring configured to press said male terminal toward said first and second sacrificial folds.

4. The connector structure according to claim 3, wherein said female terminal, said first and second sacrificial folds and said tongue spring are formed unitarily and in one piece.

5. The connector structure according to claim 2, wherein said female terminal, and said first and second sacrificial folds are formed unitarily and in one piece.

6. The connector structure according to claim 1, wherein said sacrificial electrode is formed on a part of said connector body and placed into contact with said male terminal.

7. The connector structure according to claim 6, the female terminal further comprising a tongue spring configured to press said male terminal toward said first and second sacrificial folds.

8. The connector structure according to claim 7, wherein said female terminal, said first and second sacrificial folds and said tongue spring are formed unitarily and in one piece.

9. The connector structure according to claim 6, wherein said female terminal, and said first and second sacrificial folds are formed unitarily and in one piece.

10. The connector structure according to claim 1, the female terminal further comprising a tongue spring configured to press said male terminal toward said first and second sacrificial folds.

11. The connector structure according to claim 1, wherein said female terminal, and said first and second sacrificial folds are formed unitarily and in one piece.

12. The connector structure according to claim 10, wherein said female terminal, said first and second sacrificial folds and said tongue spring are formed unitarily and in one piece.

13. An electricity generating panel connected by a connector structure comprising a connector body having a hollow portion and an axis, the connector body including a male terminal with a tip extending along the axis of the hollow portion, and a female terminal configured to be received by the male terminal along the axis of the hollow portion;

said connector body comprising a sacrificial electrode, in contact with the male terminal a tip of said sacrificial electrode extends outwardly farther than said tip of said male terminal along the axis of the hollow portion; and said female terminal comprising a first sacrificial fold and a second sacrificial fold defining a hollow portion having side edges and forming a slit extending along said axis of the hollow portion, such that, when said female terminal is fitted with said male terminal, said sacrificial electrode is positioned in said slit between said first and second sacrificial folds and between said side edges thereof.

14. The electricity generating panel according to claim 13, wherein said female terminal further comprises a tongue spring configured to press said male terminal toward said first and second sacrificial folds.

15. The electricity generating panel according to claim 14, wherein said female terminal, said first and second sacrificial folds and said tongue spring are formed unitarily and in one piece.

16. The electricity generating panel according to claim 13, for use with a solar source.

17. A connector structure comprising a connector body having a hollow portion and an axis, the connector body including a male terminal with a tip extending along the axis of the hollow portion, and a female terminal configured to be received by the male terminal along the axis of the hollow portion;

said connector body comprising a sacrificial electrode, in contact with the male terminal a tip of said sacrificial electrode extends outwardly farther than said tip of said male terminal along the axis of the hollow portion; and said female terminal comprising a first sacrificial portion and a second sacrificial portion defining a hollow portion and forming a slit extending along said axis of the hollow portion, such that, when said female terminal is fitted with said male terminal, said sacrificial electrode is positioned in said slit between said first and second sacrificial portions.

18. The connector structure according to claim 17, wherein said sacrificial electrode is formed on a part of said connector body and placed into contact with said male terminal.

19. The connector structure according to claim 18, the female terminal further comprising a tongue spring configured to press said male terminal toward said first and second sacrifice portions.

20. The connector structure according to claim 17, wherein said sacrificial electrode is formed on said male terminal.

* * * * *